US010640343B2

(12) United States Patent
Christensen et al.

(10) Patent No.: US 10,640,343 B2
(45) Date of Patent: May 5, 2020

(54) WINCH ASSEMBLY

(71) Applicant: Dutton-Lainson Company, Hastings, NE (US)

(72) Inventors: Brad Nels Christensen, Lincoln, NE (US); Brandon William Miller, Hastings, NE (US); Zane Alexander Norton, Hastings, NE (US); Todd J. Yost, Fairfield, NE (US); Jeffrey L. Dobbins, Grand Island, NE (US); Milan Norton, Hastings, NE (US); Bang Brian Tran, Hastings, NE (US)

(73) Assignee: DUTTON-LAINSON COMPANY, Hastings, NE (US)

( * ) Notice: Subject to any disclaimer, the term of this patent is extended or adjusted under 35 U.S.C. 154(b) by 141 days.

(21) Appl. No.: 16/039,754

(22) Filed: Jul. 19, 2018

(65) Prior Publication Data

US 2020/0024112 A1 Jan. 23, 2020

(51) Int. Cl.

| | |
|---|---|
| ***B66D 1/04*** | (2006.01) |
| *B66D 1/74* | (2006.01) |
| *B66D 1/34* | (2006.01) |

(52) U.S. Cl.

CPC ..... *B66D 1/04* (2013.01); *B66D 1/34* (2013.01); *B66D 1/7452* (2013.01)

(58) Field of Classification Search

CPC ..... B66D 1/04; B66D 1/34; B66D 1/7452
See application file for complete search history.

(56) References Cited

U.S. PATENT DOCUMENTS

| | | | | |
|---|---|---|---|---|
| 3,939,729 | A | 2/1976 | Brockelsby | |
| 4,215,850 | A | 8/1980 | Haase et al. | |
| 5,374,035 | A * | 12/1994 | Santos | B66D 1/12 254/323 |
| D364,027 | S | 11/1995 | Hung | |
| 5,573,091 | A | 11/1996 | Hung | |
| 6,116,580 | A | 9/2000 | Hull | |
| 7,017,887 | B1 * | 3/2006 | Verakis | B66D 1/12 254/342 |
| 7,562,862 | B1 * | 7/2009 | Jackson | B66D 3/14 254/333 |
| 7,967,278 | B2 * | 6/2011 | Anderson | B60P 3/1066 254/342 |
| 8,231,109 | B2 * | 7/2012 | Peng | B65H 75/28 242/388.5 |
| 8,360,399 | B2 | 1/2013 | Lundrigan | |

(Continued)

*Primary Examiner* — Michael E Gallion
(74) *Attorney, Agent, or Firm* — Michael S. Hargis; King & Schickli, PLLC

(57) ABSTRACT

A winch assembly includes a base having first and second sides, a first shaft supported by the base and supporting a gear and a reel, and a second shaft supported by the base and supporting a ratchet gear. The ratchet gear meshes with the gear and a pawl, and a handle is attached to the second shaft for rotation thereof. The winch includes a cover having a top movable between first and second positions and first and second sides rotatably supporting the top. The first side may include a first arm extending toward and engaging a second arm extending from the second side. The top may include hooks for engaging a shaft extending between the sides of the cover. The sides of the cover may each include at least one retainer clip and the top includes corresponding lugs for engaging the at least one retainer clips.

33 Claims, 7 Drawing Sheets

(56) References Cited

U.S. PATENT DOCUMENTS

| | | | | |
|---|---|---|---|---|
| 8,657,260 | B2 | 2/2014 | Anderson et al. | |
| 8,695,945 | B2 | 4/2014 | Guyard | |
| 8,720,865 | B2 * | 5/2014 | Anderson | B66D 1/04 254/342 |
| 9,206,022 | B2 * | 12/2015 | Burneister | B66D 1/28 |
| 9,758,357 | B2 * | 9/2017 | Anderson | B66D 1/04 |
| 9,908,757 | B2 * | 3/2018 | Morrison | B66D 1/00 |
| 10,414,639 | B2 * | 9/2019 | Downs | B66D 1/06 |
| 2008/0061277 | A1 * | 3/2008 | Grapes | B66D 3/02 254/352 |
| 2017/0362066 | A1 * | 12/2017 | Grapes | B66D 1/06 |

* cited by examiner

WINCH ASSEMBLY

TECHNICAL FIELD

This document relates generally to winch assemblies, and more specifically to winch assemblies having a cover.

BACKGROUND

Winch assemblies are commonly used to provide assistance in moving or loading cargo onto a trailer where the cargo is secured for transport. The transported cargo may include boats, automobiles, crates, and/or any heavy or cumbersome objects. Winches are typically mounted to a tongue of the trailer and utilize a strap, cable, or the like to pull the cargo onto the trailer. A handle is used to rotate a drum around which the strap is wound thus moving the cargo toward the winch and onto the trailer or away from the winch and off of the trailer.

Traditionally, winch assemblies utilize a primary gear that meshes with a secondary gear to turn the drum in response to movement of the handle. A pawl is also used to lock the gears in place. Traditionally, these and other components have been exposed both visually and to the elements. While some manufacturers have recently enclosed these core components within covers, the covers are difficult to remove in the event access to the core components is desired. Accordingly, a need exists for a cover that provides access to the core components of the winch assembly for maintenance or the like without the need to completely remove the cover. Even more, the cover should be able to be positioned over the winch either before or after the winch is mounted to the trailer.

SUMMARY OF THE INVENTION

In accordance with the purposes and benefits described herein, a winch assembly is provided. The winch assembly may be broadly described as including a base having first and second sides, a first shaft extending through the first and second sides and supporting a gear, and a second shaft extending through the first and second sides and supporting a ratchet gear. The ratchet gear meshes with the gear and a pawl supported by a third shaft extending through the first and second sides. A cover supported by the base includes an upper member movable between first and second positions.

In another possible embodiment, the winch assembly further includes a handle attached to the second shaft for rotating the second shaft.

In yet another possible embodiment, the cover includes first and second sides supporting the upper member.

In still another possible embodiment, the first side of the cover includes an arm extending toward and supported by the second side of the cover. In another, the arm includes a nib extending toward the second side and the second side includes a pocket for receiving the nib. In yet another, the second side of the cover includes a second arm extending toward the first side of the cover. In one additional embodiment, the arm includes a nib extending toward the second arm and the second arm includes a pocket for receiving the nib.

In another possible embodiment, the arm supports an insert for receiving a bolt extending through the second side of the cover for securing the first and second sides of the cover together.

In still yet another possible embodiment, the second side of the cover includes a second arm extending toward the first side of the cover and the arm includes a nib extending toward the second arm and the second arm includes a pocket for receiving the nib.

In one additional possible embodiment, the upper member of the cover includes at least one hook engaging the bolt.

In another possible embodiment, the upper member of the cover includes a pair of hooks for engaging a third shaft extending between first and second sides of the cover.

In yet another possible embodiment, the pawl includes a lever and further includes a cover for the lever. In this embodiment, the cover extends at least partially through an aperture formed in the upper member of the cover.

In one additional possible embodiment, a winch assembly including a base supporting a reel and a gear on a first shaft, a ratchet gear on a second shaft meshing with the gear for rotating the reel, a pawl for engaging the ratchet gear, and a handle attached to the second shaft, includes a cover having first and second sides and a top rotatable between first and second positions.

In another possible embodiment, the first side includes a first arm extending toward and engaging a second arm extending from the second side.

In still another possible embodiment, the first arm includes an aligner extending toward the second arm for engaging an aperture formed in the second arm.

In one other possible embodiment, the top includes at least one hook for engaging a third shaft extending between the first and second sides.

In yet another possible embodiment, the third shaft is supported by the first and second arms.

In still yet one other possible embodiment, the shaft is a bolt extending through the first side and a channel formed in the first arm and engaging a threaded insert supported by the second arm.

In another possible embodiment, the first side includes at least one retainer clip and the top includes at least one lug.

In still another possible embodiment, the second side includes at least one retainer clip and the top includes at least one additional lug.

In one more additional embodiment, a winch assembly includes a base having first and second sides, a first shaft supported by the base and supporting a gear and a reel, and a second shaft supported by the base and supporting a ratchet gear. The ratchet gear meshes with the gear and a pawl supported by a third shaft supported by the base, and a handle is attached to the second shaft for rotating the second shaft. The winch assembly further includes a cover having a top movable between first and second positions and first and second sides rotatably supporting the top.

In another possible embodiment, the first side includes a first arm extending toward and engaging a second arm extending from the second side along an end of the base.

In still another possible embodiment, the first arm includes a nib for engaging an aperture formed in the second arm.

In yet another possible embodiment, the top includes first and second hooks for engaging a fourth shaft extending between the first and second sides of the cover.

In one other possible embodiment, the fourth shaft is a bolt extending through a channel formed in the first arm into an insert supported by the second arm.

In still another possible embodiment, the first and second sides of the cover each include at least one retainer clip and the top includes corresponding lugs for engaging the at least one retainer clips.

In another possible embodiment, the top includes first and second hooks for engaging a fourth shaft extending between the first and second sides of the cover.

In still another possible embodiment, the first side includes a first arm having a nib extending toward and engaging an aperture in a second arm extending from the second side along an end of the base.

In yet still another possible embodiment, the winch assembly further includes a cover for the ratchet that extends at least partially through an aperture formed in the top of the cover in a closed position.

In the following description, there are shown and described several embodiments of winch assemblies. As it should be realized, the assemblies are capable of other, different embodiments and their several details are capable of modification in various, obvious aspects all without departing from the assemblies as set forth and described in the following claims. Accordingly, the drawings and descriptions should be regarded as illustrative in nature and not as restrictive.

BRIEF DESCRIPTION OF THE DRAWING FIGURES

The accompanying drawing figures incorporated herein and forming a part of the specification, illustrate several aspects of the winch assemblies and together with the description serve to explain certain principles thereof. In the drawing figures.

Reference will now be made in detail to the present preferred embodiments of the winch assembly, examples of which are illustrated in the accompanying drawing figures, wherein like numerals are used to represent like elements.

DETAILED DESCRIPTION

Figure 1:
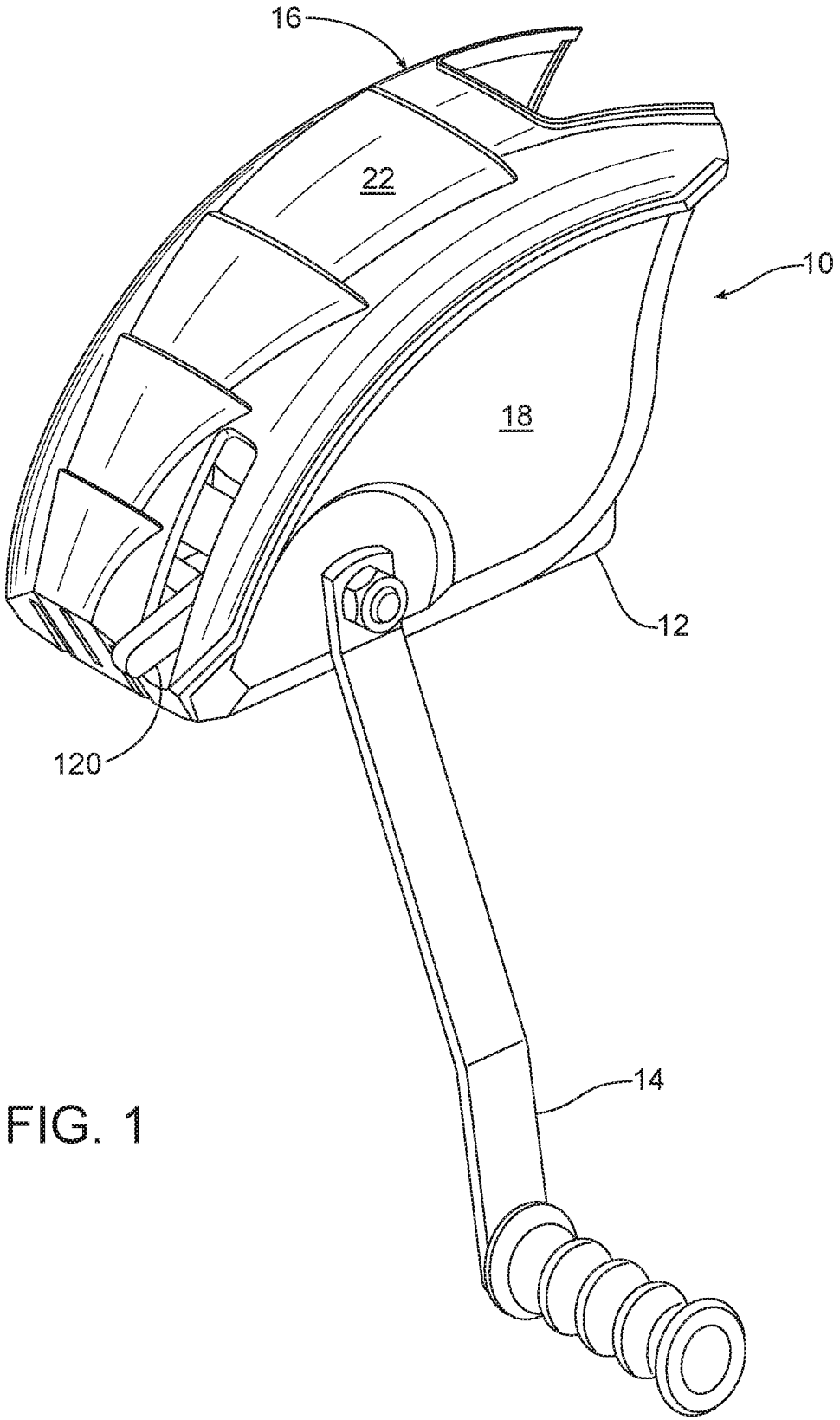
FIG. 1 is a perspective view of a winch assembly.

Reference is now made to FIG. 1 which illustrates a perspective view of an exemplary embodiment of a winch assembly 10. The winch assembly 10 includes a base 12, a handle assembly 14, and a cover 16. The cover 16 includes a first side 18, a second side 20 (not visible in this figure), and an upper member or top 22.

Figure 2:
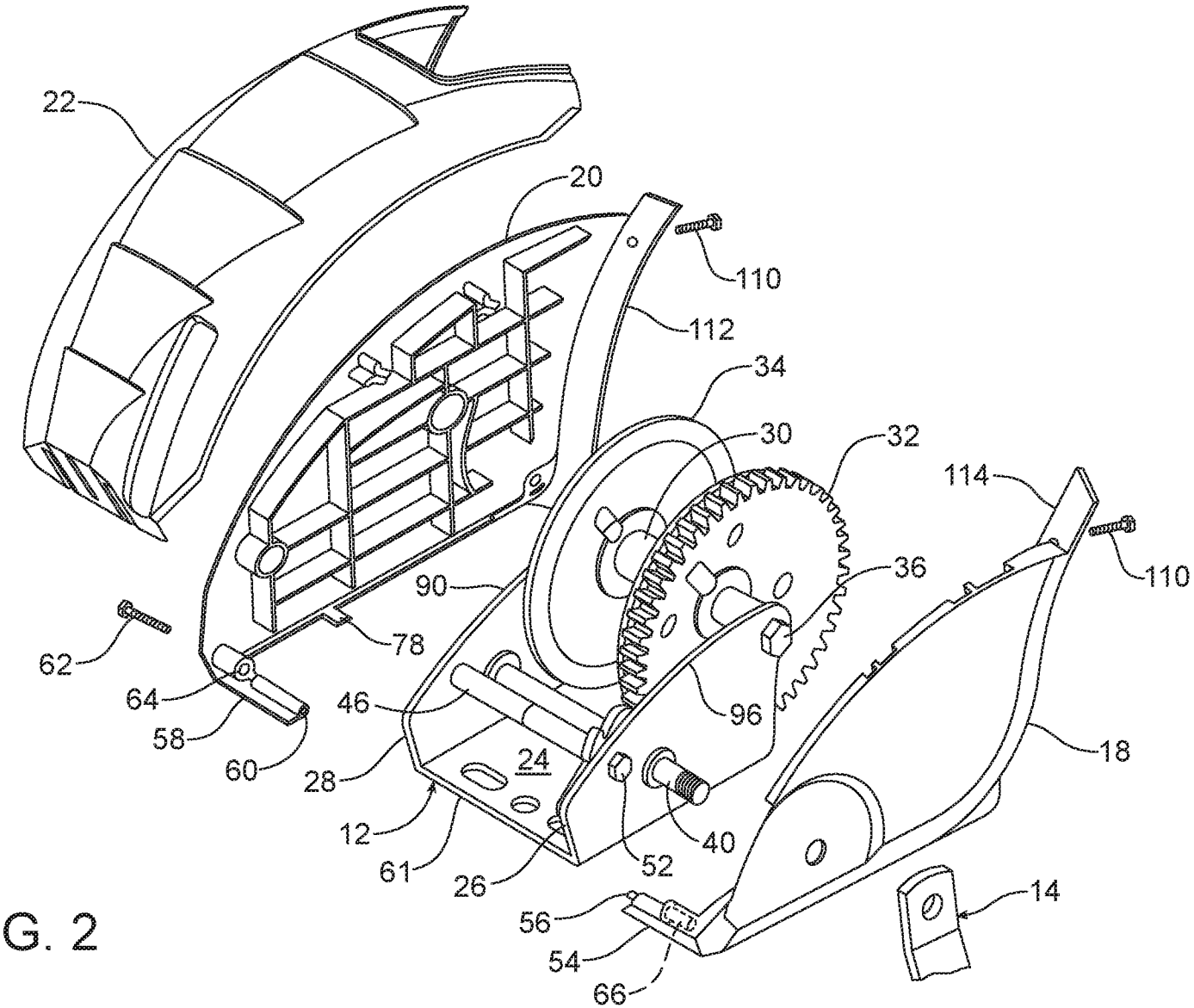
FIG. 2 is a partially exploded perspective view of the winch assembly.

As shown in the partially exploded view of FIG. 2, the base 12 is generally U-shaped in the described embodiment including a floor 24 and generally parallel first and second sides 26, 28. Additional aspects of the base 12 designed to accommodate the cover 16 will be described in further detail below. Broadly speaking, however, the base 12 supports a first shaft or axle 30. As shown, the first shaft 30 extends between and is supported by the first and second sides 26, 28. A drum reel 34 is attached to and supported by the first shaft 30. The first shaft 30 is further attached to and supports a drum gear 32 for rotating the drum reel 34 in response to rotation of the handle assembly 14. As is known in the art, a strap or cable or the like (not shown for clarity) is wound around the drum reel 34 during use to move an attached object such as a boat for example. A bolt 36 extends through the first side 26, the shaft 30, the drum gear 32, the drum reel 34, and the second side 28 of the base 12 securing the drum gear and drum reel in position. Although not shown in this figure, a nut 38 is threaded onto the bolt 36 on the outside of the second side 28 of the base 12 securing the bolt in position.

Figure 3:
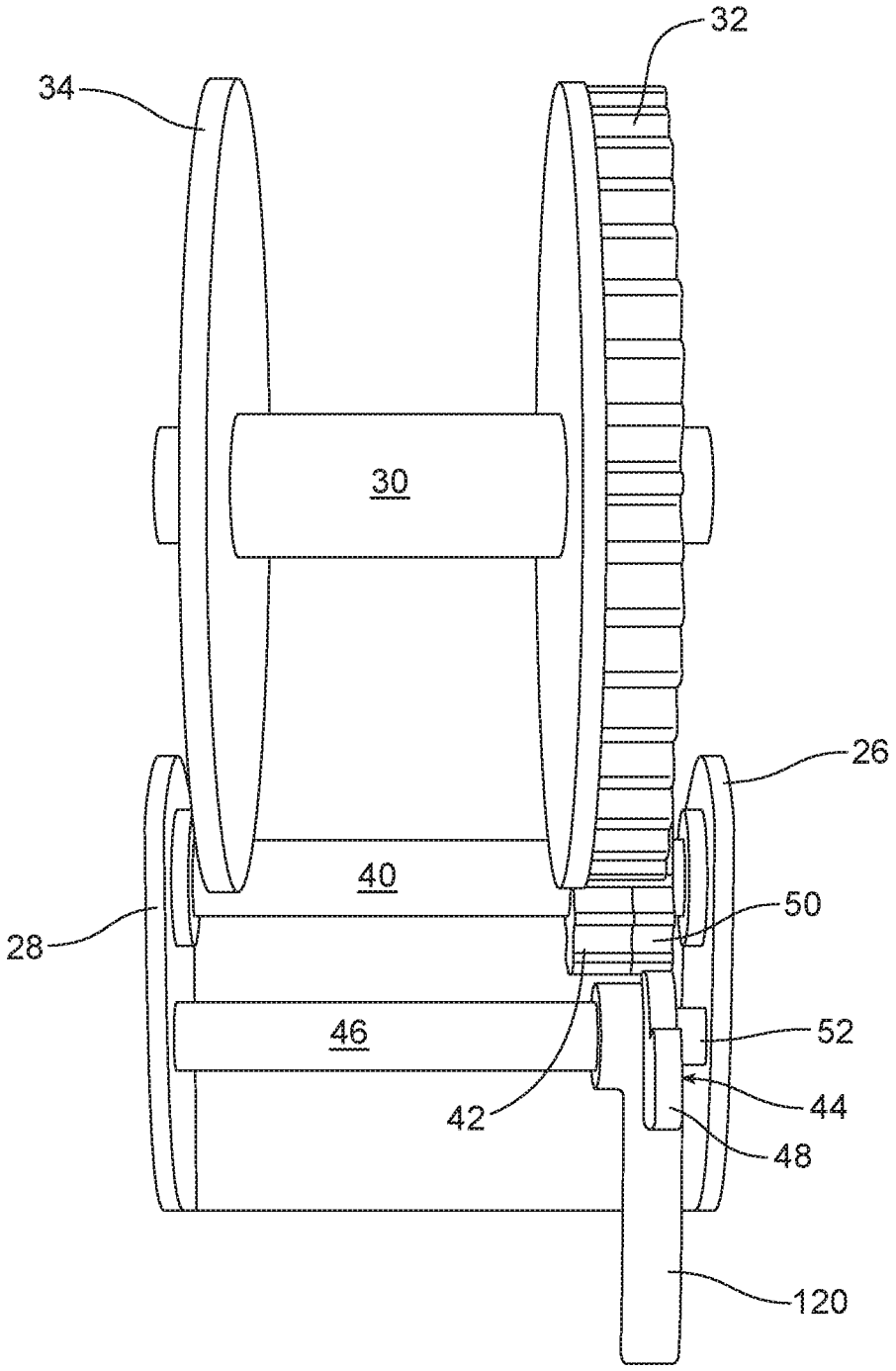
FIG. 3 is a partial perspective view of the working components of the winch assembly.

As further shown, the base 12 supports a second shaft or axle 40 which similarly extends between and is supported by the first and second sides 26, 28 of the base 12. As best shown in FIG. 3, a ratchet gear 42 is attached to and supported by the second shaft 40 and continuously meshes with the drum gear 32. The handle assembly 14 is utilized to turn the second shaft or axle 40 during use thereby rotating the ratchet gear 42 which meshes with and rotates the drum gear 32 and drum reel 34 to wind or unwind the strap or cable. As best shown in FIG. 2, the handle assembly 14 is attached to an end portion of the second shaft 40 extending through the first side 26 of the base and the first side 18 of the cover 16. The shaft 40 may extend through an aperture formed in the first side 26 wherein the cover is at least partially secured in position, or through a slot or similar cut-away of the cover 16 which opens to an edge thereof allowing the cover to be positioned over the shaft without removing the handle assembly 14 in an alternate embodiment.

As is known in the art, a ratchet and pawl system 44 is utilized to control movement of the ratchet gear 42 and the drum gear 32 and numerous different types and configurations of ratchet and pawl systems may be utilized in accordance with the present invention. In the described embodiment, however, the ratchet and pawl system 44 is supported by a third shaft or axle 46 extending between the first and second sides 26, 28 of the base 12. As shown in FIG. 3, a pawl 48 engages teeth 50 of the ratchet gear 42 providing control over movement of the drum gear 32 and drum reel 34. Again, these components are secured in position using a bolt 52 which extends through the first side 26, the third shaft 46, the ratchet and pawl system 44, and the second side 28. Although not shown in this figure, a nut 53 is threaded onto the bolt 52 on the outside of the second side 28 of the base 12 securing the bolt in position.

As emphasized in the partially exploded perspective view of FIG. 2, the upper member or top 22 of the cover 16 includes an ornamental design and is separable from the first and second sides 18, 20. This three-piece design allows for the cover 16 to be attached to the overall winch assembly 10 before or after the assembly 10 has been mounted (e.g., mounted on a trailer). As will become more apparent below, the upper member or top 22 is pivotally connected to the first and second sides 18, 20 of the cover 16 which provides for movement between first and second positions. In the described embodiment, the first and second positions are fully open and fully closed. There are no limitations, however, on the first and second positions. Alternatively, the top 22 may be fully removed from the winch assembly before, during, or after installation. Whether the top 22 is pivoted to an open or partially open position, or fully removed, each accommodates installation of the winch assembly 10 and provides access to the underlying components thereof for maintenance purposes or otherwise. This is the case whether the first and second sides 18, 20 of the cover 16 are attached to or supported by the base 12, as described further below, or not.

In order to provide the noted flexibility of the cover 16 with regard to attachment to the overall winch assembly 10 before or after the assembly has been mounted, the cover includes several features which position and support it in position relative the base 12. In addition, the cover 16 is only minimally secured to the base 12 when installed via extension of the second shaft 40 through the first side 18 where the handle assembly 14 is attached. Otherwise, the cover 16 may be fully removed with no effect on the underlying components of the winch assembly 10.

As shown in FIG. 2, the first side 18 of the cover 16 includes an arm 54 extending toward the second side 20. The arm 54 includes an aligner or a nib 56 extending from the arm 54 for engaging and locating an opposing arm 58 extending from the second side 20. More specifically, the arm 58 includes an aperture or pocket 60 formed therein for receiving the nib 56 to assist in the alignment of the first and second sides 18, 20 during manufacturing or installation. When the sides are installed, the nib 56 extends into the aperture 60 and an end of each of arms 54, 58 abut one another adjacent a first end 61 of the base floor 24.

Figure 4:
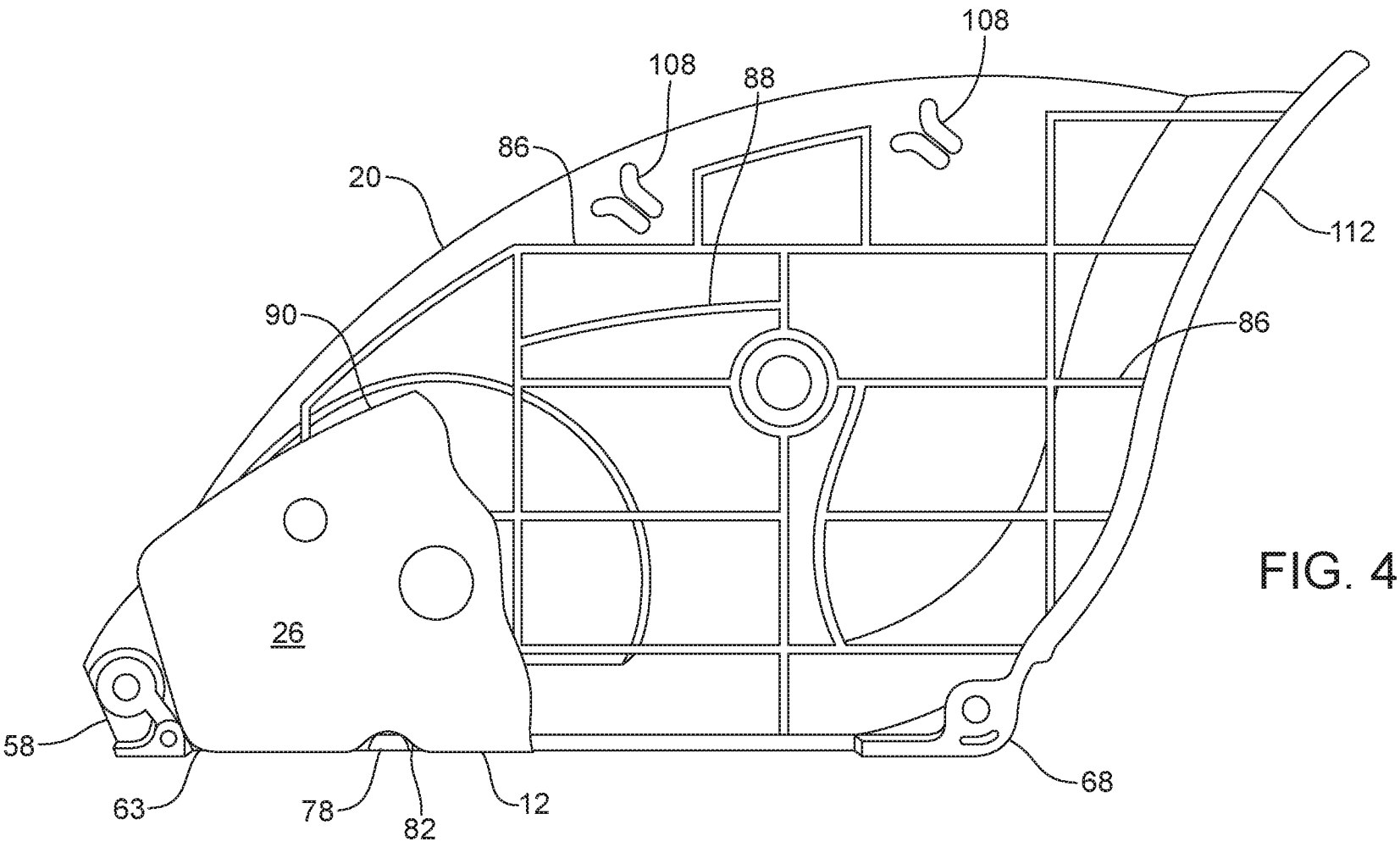
FIG. 4 is a side plan view of a side of a cover for the winch assembly.

The arms 54, 58 further align the sides 28, 20 relative the base 12 through contact with the first end 61. As best shown in FIG. 4, the base 12 includes a radius along an outer surface 63. An outer surface of each arm 54, 58 generally conforms with and engages the radius of the base 12 which aligns the first and second sides 18, 20 and resists movement of the cover relative the base. In this nested position, the first and second sides 18, 20 are directly adjacent the base 12 and are secured using a bolt 62. In the described embodiment, the bolt 62 is inserted through a borehole 64 formed in the side 20 and is received in an insert 66 secured within or formed in the side 18. Even more, the insert 66 is threaded and receives a threaded portion of the bolt 62. While the bolt 62 is shown as threaded along an entirety of a shaft of the bolt in an alternate embodiment the bolt could be only partially threaded along an end portion.

Figure 5:
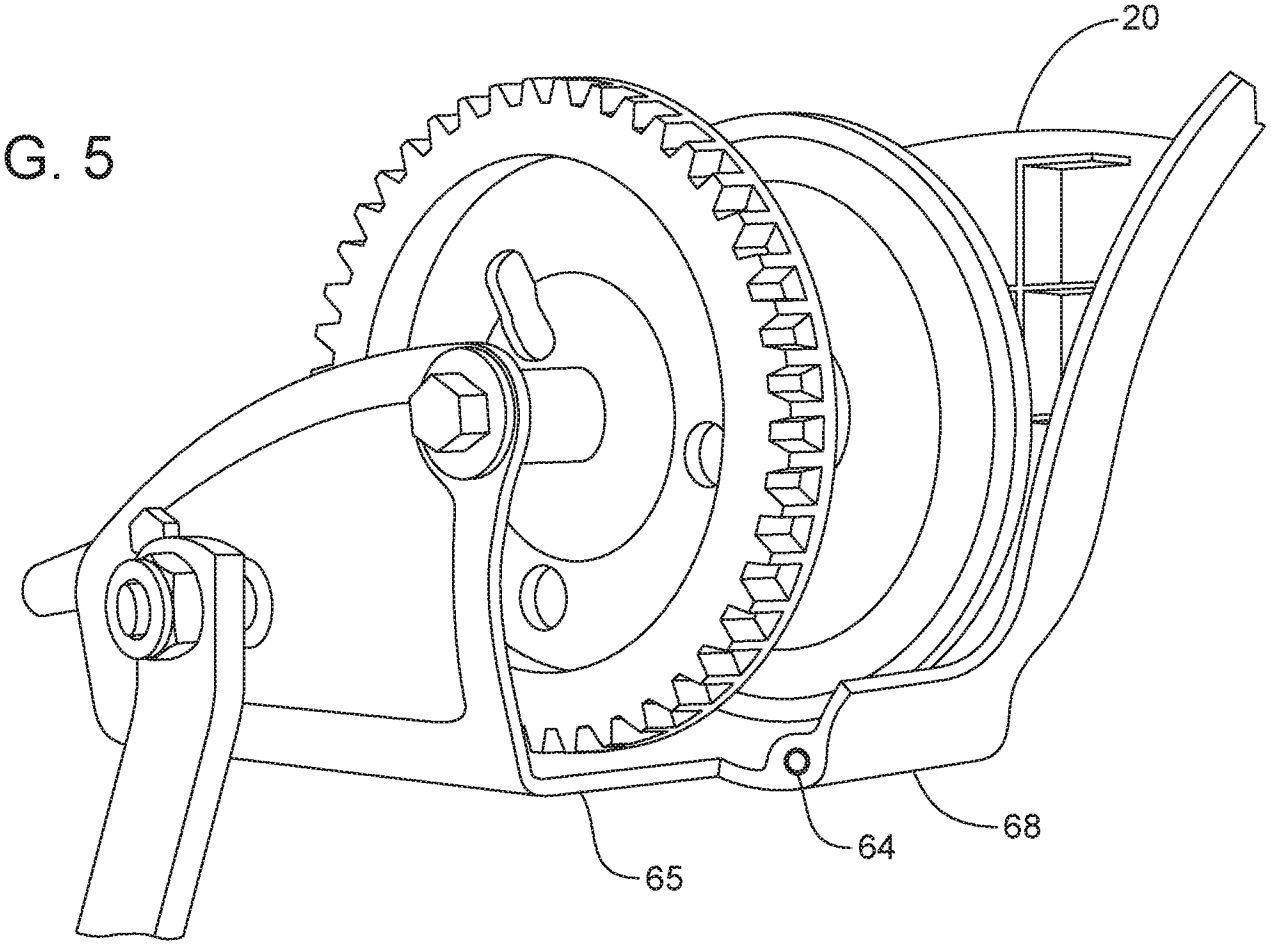
FIG. 5 is a partial perspective view showing an arm extending from a side of the cover and abutting an end of a base of the winch assembly.

In a similar manner as shown in FIG. 5, albeit along a second end 65 of the base floor 24, a second arm 68 extends from the second side 20 toward a second arm 70 extending from the first side 18. Again, an end of each of the second arms 68, 70 abut one another adjacent the second end 65 of the base floor 24 and are secured in this position using a bolt 72 (not shown). In the described embodiment, the bolt 72 is inserted through a borehole 64 formed in the second arm 68 and received in an insert 76 secured within or formed in the second arm 70. Even more, the insert 76 is threaded and receives a threaded portion of the bolt 72. In this position, the second arms 68, 70 abut the second end 65.

In order to further provide the noted flexibility of the cover 16 and ensure proper positioning thereof relative the base 12, a nub 78 extends from a lower edge of the second side 20 as shown in FIG. 2. More specifically, the nub 78 extends toward the first side 18 and engages and/or self-locates within a channel 82 (shown in FIG. 4) formed in the floor 24 of the base 12. In the described embodiment, the channel 82 extends across the entire floor 24 and a corresponding nub 84 extending from the second side 20 toward the first side 18 similarly engages and/or self-locates within the channel. Of course, the channel and the nubs can take any shapes sufficient to engage and/or assist in locating the cover sides relative the base. Even more, separate channels adjacent the nubs could be utilized in place of a full-length channel.

As best shown in FIG. 4, a plurality of ribs 86 are formed in the second side 20 of the cover 16. As is known in the art, one of the ways to strengthen a part is to add one or more ribs to the design. The ribs are thin protrusions that extend generally perpendicular from the side 20 to provide added stiffness and strength without increasing a thickness of the side 20. Even more, a portion of the plurality of ribs 86 is formed to provide the noted flexibility of the cover 16 and ensure proper positioning of the cover 16 relative the base 12. In the described embodiment, rib 88 extends closer to the base 12 than a remaining portion of the plurality of ribs and generally conforms to an upper edge 90 of the second side wall 28 of the base 12. In this manner, the upper edge 90 engages and/or self-locates the upper edge relative the rib 88.

Figure 6:
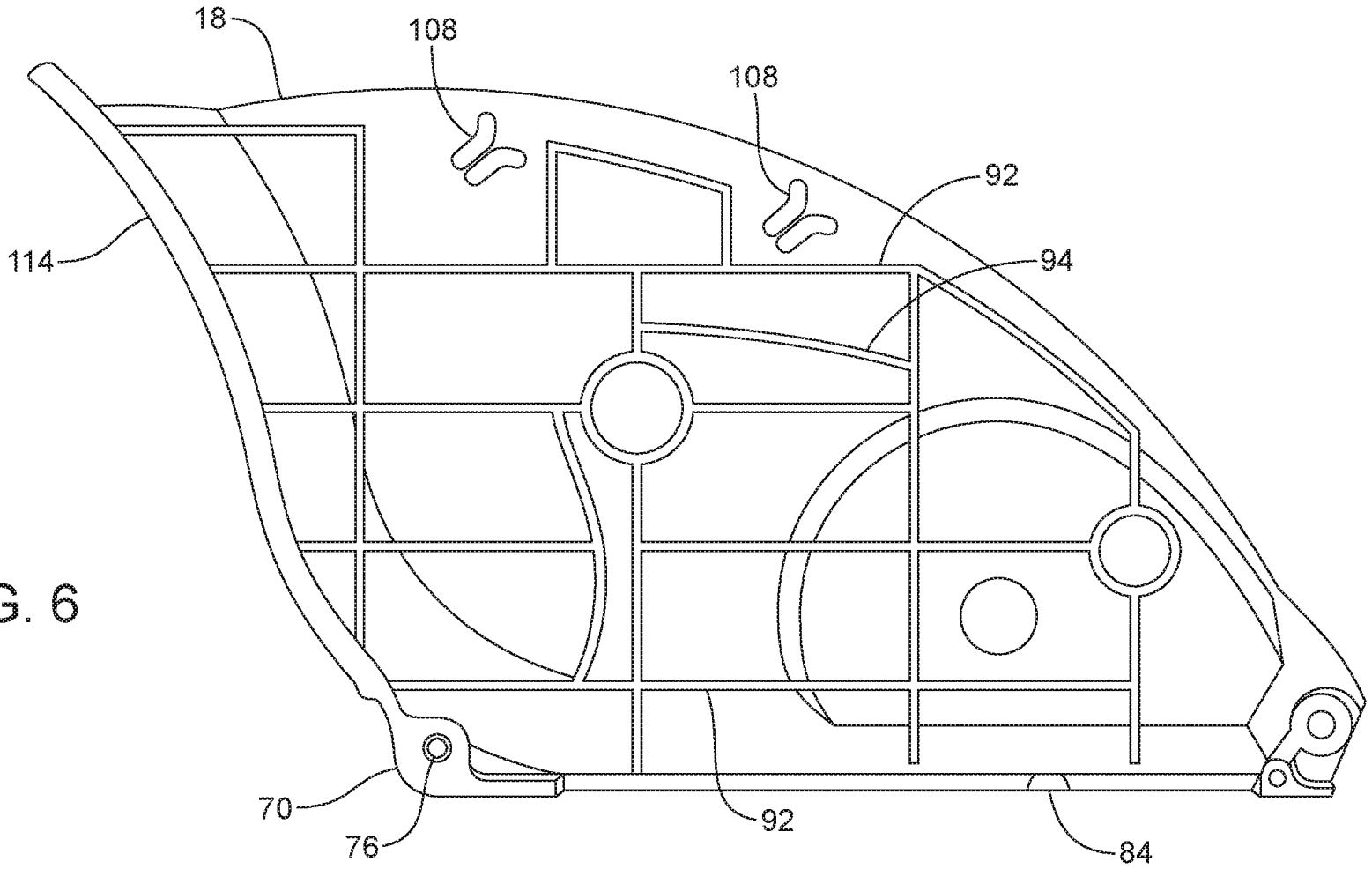
FIG. 6 is a side plan view of an opposing side of the cover for the winch assembly.

As the cover sides 18 and 20 are generally mirror images of one another, albeit with certain differences, cover side 18 similarly includes a plurality of ribs 92 as shown in FIG. 6. The plurality of ribs 92 provide added stiffness and strength including a rib 94 that extends closer to the base 12 than a remaining portion of the plurality of ribs. The rib 94 generally conforms to an upper edge 96 of the first side wall 26 of the base 12 providing the desired positioning of the cover 16 relative the base 12.

Figure 7:
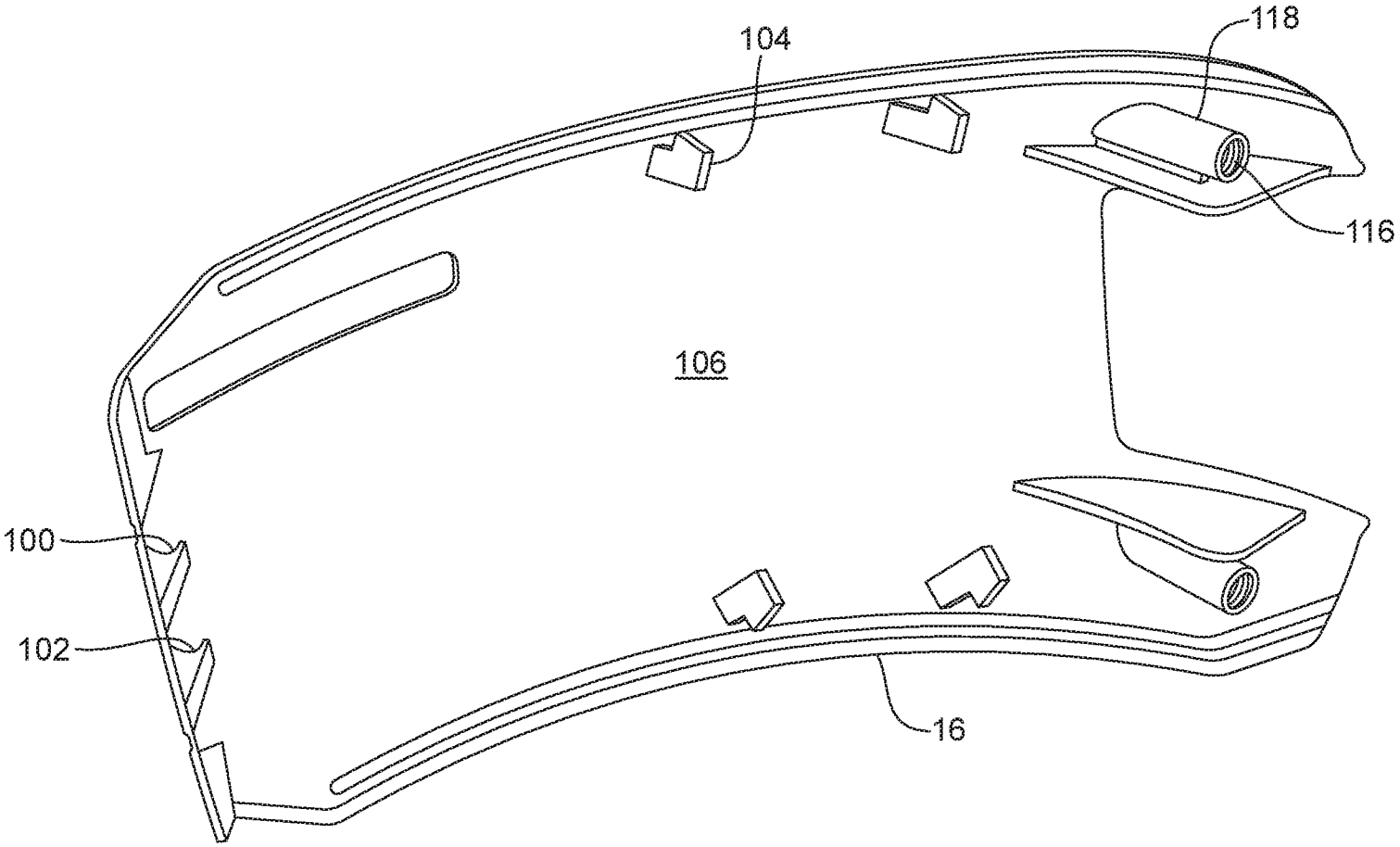
FIG. 7 is a perspective view of a top of the cover.

As noted above, the upper member or top 22 is pivotally connected to the first and second sides 18, 20 of the cover 16 which provides for movement between first and second positions. In order to provide the pivotal movement, the top 22 includes at least one hook. In the described embodiment, a pair of hooks 100, 102 are utilized. The pair of hooks 100, 102 engage and rotate around the bolt 62 utilized to secure the first and second sides 18, 20 as described above. The bolt 62 includes a shaft which in the described embodiment is not threaded except along the end portion that is received by insert 66. As shown in FIG. 7, the hooks 100, 102 are integrally molded in the top 22 and are shaped to allow the top to be positioned after installation of the cover sides 18, 20 whether or not the winch assembly 10 has been mounted to a trailer or otherwise. In other words, the hooks 100, 102 are shaped to slide under the bolt 62 with the cover sides 18, 20 in position, engage the bolt 62, and rotate about an axis extending lengthwise through the bolt shaft.

In order to align the top 22 with the cover sides 18, 20 when transitioning from an open position to a closed position, the top 22 may include at least one alignment lug 104 extending from an inner surface 106 thereof. Corresponding pinch or retainer clips 108 aligned to receive the alignment lugs 104 as the top 22 transitions are formed in the cover sides 18, 20. In this manner, the top 22 is properly aligned during a final portion of the pivoting movement and secured in position when in the closed position.

In the described embodiment, four alignment lugs 104 are utilized which each extend from the inner surface 106 of the top 22. Each of the alignment lugs 104 are angled to allow them to be received in the corresponding pinch clips 108. As shown, the pinch clips 108 are integrally molded in the cover sides 18, 20 and are designed to deform when receiving their respective alignment lug 104 thereby slowing the pivoting motion during the final portion of the pivoting movement and securing the top 22 in the closed position. Of course, fewer or more alignment lugs and corresponding pinch clips may be utilized.

Once in the closed position, the top 22 may be more permanently secured to the cover sides 18, 20 utilizing one more bolts or other means. In the described embodiment, for example, each of the cover sides 18, 20 includes a flange 112, 114, respectively, through which a bolt 110 is inserted. Each bolt 110 is received in an insert 116 secured within a post 118 formed in the top 22 as shown in FIG. 7.

It should further be noted that a cover or grip 120 is attached to the ratchet as best shown in FIG. 1. The cover 120 essentially extends the ratchet through the top 22 allowing the user easier access and provides an improved gripping surface over a metal ratchet. In the described embodiment, the cover 120 is made of plastic but other materials may also be utilized.

In summary, numerous benefits result from the winch assemblies illustrated in this document. The winch assemblies incorporate a unique cover that includes sides and a top. Whether the top is pivoted or rotated to an open or partially open position or is fully removed, each position accommodates installation of the assembly and provides access to the underlying components of the winch assembly for maintenance purposes or otherwise. Even more, the cover is capable of being put on the winch either before or after the winch is mounted.

The foregoing has been presented for purposes of illustration and description. It is not intended to be exhaustive or to limit the embodiments to the precise form disclosed. Obvious modifications and variations are possible in light of the above teachings. For example, each element of each cover side, for example, arms, nibs, nubs, flanges, ribs, and/or receiver clips and others, may be integrally molded. Similarly, each element of the top of the cover, for example, aligning lugs, hooks, ribs, and grooves may be integrally molded. All such modifications and variations are within the scope of the appended claims when interpreted in accordance with the breadth to which they are fairly, legally and equitably entitled.

The invention claimed is:

1. A winch assembly, comprising:

a base having first and second sides;

a first shaft extending through the first and second sides and supporting a gear;

a second shaft extending through the first and second sides and supporting a ratchet gear, the ratchet gear meshing with the gear, and a pawl supported by a third shaft extending through the first and second sides; and a cover supported by the base, the cover having at least one side and an upper member movable relative the at least one side between first and second positions.

2. The winch assembly of claim 1, further comprising a handle attached to the second shaft for rotating the second shaft.

3. The winch assembly of claim 1, wherein the first side of the cover includes an arm extending toward and supported by the second side of the cover.

4. The winch assembly of claim 3, wherein the arm includes a nib extending toward the second side and the second side includes a pocket for receiving the nib.

5. The winch assembly of claim 3, wherein the second side of the cover includes a second arm extending toward the first side of the cover.

6. The winch assembly of claim 5, wherein the arm includes a nib extending toward the second arm and the second arm includes a pocket for receiving the nib.

7. The winch assembly of claim 3, wherein the arm supports an insert for receiving a bolt extending through the second side of the cover for securing the first and second sides of the cover together.

8. The winch assembly of claim 7, wherein the second side of the cover includes a second arm extending toward the first side of the cover and the arm includes a nib extending toward the second arm and the second arm includes a pocket for receiving the nib.

9. The winch assembly of claim 7, wherein the upper member of the cover includes at least one hook engaging the bolt.

10. The winch assembly of claim 1, wherein the upper member of the cover includes a pair of hooks for engaging a third shaft extending between first and second sides of the cover.

11. The winch assembly of claim 1, wherein the pawl includes a lever and further comprising a cover for the lever, the cover extending at least partially through an aperture formed in the upper member of the cover when the cover is in a closed position.

12. A winch assembly including a base supporting a reel and a gear on a first shaft, a ratchet gear on a second shaft meshing with the gear for rotating the reel, a pawl for engaging the ratchet gear, and a handle attached to the second shaft, comprising:

a cover including first and second sides and a top rotatable between first and second positions relative the first and second sides.

13. The winch assembly of claim 12, wherein the first side includes a first arm extending toward and engaging a second arm extending from the second side.

14. The winch assembly of claim 13, wherein the first arm includes an aligner extending toward the second arm for engaging an aperture formed in the second arm.

15. The winch assembly of claim 12, wherein the top includes at least one hook for engaging a third shaft extending between the first and second sides.

16. The winch assembly of claim 15, wherein the third shaft is supported by the first and second arms.

17. The winch assembly of claim 16, wherein the shaft is a bolt extending through the first side and a channel formed in the first arm and engaging a threaded insert supported by the second arm.

18. The winch assembly of claim 12, wherein the first side includes at least one retainer clip and the top includes at least one lug.

19. The winch assembly of claim 18, wherein the second side includes at least one retainer clip and the top includes at least one additional lug.

20. A winch assembly, comprising:

a base having first and second sides;

a first shaft supported by the base and supporting a gear and a reel;

a second shaft supported by the base and supporting a ratchet gear, the ratchet gear meshing with the gear and a ratchet and pawl supported by a third shaft supported by the base;

a handle attached to the second shaft for rotating the second shaft; and a cover having a top movable between first and second positions relative first and second cover sides rotatably supporting the top.

21. The winch assembly of claim 20, wherein the first side includes a first arm extending toward and engaging a second arm extending from the second side along an end of the base.

22. The winch assembly of claim 21, wherein the first arm includes a nib for engaging an aperture formed in the second arm.

23. The winch assembly of claim 20, wherein the top includes first and second hooks for engaging a fourth shaft extending between the first and second sides of the cover.

24. The winch assembly of claim 23, wherein the fourth shaft is a bolt extending through a channel formed in the first arm into an insert supported by the second arm.

25. The winch assembly of claim 20, wherein the first and second sides of the cover each include at least one retainer clip and the top includes corresponding lugs for engaging the at least one retainer clips.

26. The winch assembly of claim 25, wherein the top includes first and second hooks for engaging a fourth shaft extending between the first and second sides of the cover.

27. The winch assembly of claim 26, wherein the first side includes a first arm having a nib extending toward and engaging an aperture in a second arm extending from the second side along an end of the base.

28. The winch assembly of claim 20, further comprising a cover for the ratchet, the cover extending at least partially through an aperture formed in the top of the cover in a closed position.

29. A winch assembly, comprising:

a base having first and second sides;

a first shaft extending through the first and second sides and supporting a gear;

a second shaft extending through the first and second sides and supporting a ratchet gear, the ratchet gear meshing with the gear, and a pawl supported by a third shaft extending through the first and second sides; and a cover supported by the base, the cover having an upper member movable between first and second positions and including at least one hook for engaging a shaft extending between first and second sides of the cover.

30. A winch assembly including a base supporting a reel and a gear on a first shaft, a ratchet gear on a second shaft meshing with the gear for rotating the reel, a pawl for engaging the ratchet gear, and a handle attached to the second shaft, comprising:

a cover including first and second sides and a top rotatable between first and second positions includes at least one hook for engaging a third shaft extending between the first and second sides.

31. A winch assembly including a base supporting a reel and a gear on a first shaft, a ratchet gear on a second shaft meshing with the gear for rotating the reel, a pawl for engaging the ratchet gear, and a handle attached to the second shaft, comprising:

a cover including first and second sides and a top rotatable between first and second positions, wherein the first side includes at least one retainer clip and the top includes at least one lug.

32. A winch assembly, comprising:

a base having first and second sides;

a first shaft supported by the base and supporting a gear and a reel;

a second shaft supported by the base and supporting a ratchet gear, the ratchet gear meshing with the gear and a ratchet and pawl supported by a third shaft supported by the base;

a handle attached to the second shaft for rotating the second shaft; and a cover having a top movable between first and second positions first and second sides rotatably supporting the top, wherein the first and second sides of the cover each include at least one retainer clip and the top includes corresponding lugs for engaging the at least one retainer clips.

33. A winch assembly, comprising:

a base having first and second sides;

a first shaft supported by the base and supporting a gear and a reel;

a second shaft supported by the base and supporting a ratchet gear, the ratchet gear meshing with the gear and a ratchet and pawl supported by a third shaft supported by the base;

a handle attached to the second shaft for rotating the second shaft; and a cover having a top movable between first and second positions first and second sides rotatably supporting the top, wherein the top includes first and second hooks for engaging a shaft extending between the first and second sides of the cover.

* * * * *